United States Patent [19]

Knapp et al.

[11] Patent Number: 4,487,470

[45] Date of Patent: Dec. 11, 1984

[54] ANTI-DECOUPLING MECHANISM FOR AN ELECTRICAL CONNECTOR ASSEMBLY

[75] Inventors: Anthony W. Knapp, Laurens; Eric F. Shepler, Sidney, both of N.Y.

[73] Assignee: The Bendix Corporation, Southfield, Mich.

[21] Appl. No.: 493,534

[22] Filed: May 11, 1983

[51] Int. Cl.[3] ..... H01R 13/623

[52] U.S. Cl. ..... 339/89 M; 339/DIG. 2

[58] Field of Search ..... 339/89 R, 89 C, 89 M, 339/90 R, 90 C, DIG. 2; 285/82, 89, 92; 267/156; 192/72, 81 C

[56] References Cited

U.S. PATENT DOCUMENTS

| | | | |
|---|---|---|---|
| 718,366 | 1/1903 | Freund | 83/345 |
| 957,504 | 5/1910 | Frenot | 411/143 |
| 1,011,871 | 12/1911 | Smoke | 411/331 |
| 2,928,514 | 3/1960 | Clausing et al. | 192/81 C |
| 3,018,097 | 1/1962 | Johansson | 267/156 |
| 3,222,046 | 12/1965 | Thorner | 267/156 |
| 3,517,371 | 6/1970 | Buckley | 339/89 |
| 3,532,197 | 10/1970 | King | 267/156 |
| 3,594,700 | 7/1971 | Nava | 339/89 R |
| 3,598,210 | 8/1971 | Barr | 192/72 |
| 3,646,495 | 2/1972 | Cowmeadow | 339/46 C |
| 3,663,926 | 5/1972 | Brandt | 339/89 R |
| 3,669,472 | 6/1972 | Nadsady | 339/89 R |
| 3,786,396 | 1/1974 | Kemmer | 339/89 R |
| 3,801,954 | 4/1974 | Dorrel | 339/90 R |
| 3,917,373 | 11/1975 | Peterson | 339/89 R |
| 3,971,614 | 7/1976 | Paoli et al. | 339/89 |
| 4,007,953 | 2/1977 | Powell | 339/89 R |
| 4,030,798 | 6/1977 | Paoli | 339/89 R |
| 4,056,298 | 11/1977 | Cooper | 339/89 M |
| 4,066,315 | 1/1978 | Arneson | 339/89 M |
| 4,165,910 | 8/1979 | Anderson | 339/89 M |
| 4,359,255 | 11/1982 | Gallusser et al. | 339/90 R |
| 4,427,100 | 1/1984 | Rude et al. | 192/81 C |
| 4,437,552 | 3/1984 | Toyama | 192/81 C |

*Primary Examiner*—John McQuade

*Attorney, Agent, or Firm*—C. D. Lacina

[57] ABSTRACT

A thin, flat, elongated band (50) of flexible material having opposite ends and of roughened surfaces is slidably wrapped about itself several times and around a plug shell (20) such that one end is confined against the plug shell and the other end is connected by a tab (52) to a coupling nut (30), the coupling nut including on its inner wall a plurality of radial detents (42) sized to successively receive the tab (52) upon rotation of the coupling nut, rotation of the coupling nut (30) and threadable coupling with a receptacle shell (10) in a coupling direction drawing the shells (10, 20) together whereby cooperating flanges (36, 22) on the coupling nut and plug shell and thread flanks are tightly abutting, coupling rotation tending to unwrap the band (50) so that it will slide freely about the plug shell, uncoupling rotation being resisted by the band tightly coiling so that it will not slide about the plug shell, increased external torque camming the tab (52) from its detent (42) and into the next detent, the band (50) thereby providing resistance only to unwanted uncoupling.

8 Claims, 4 Drawing Figures

FIG. 2
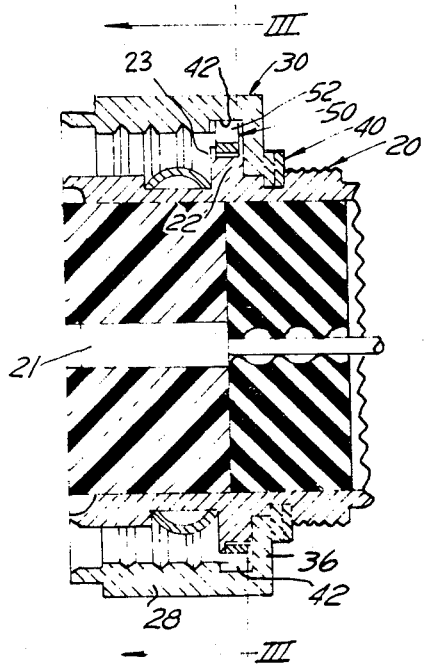
FIG. 4
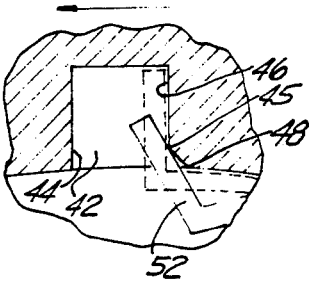
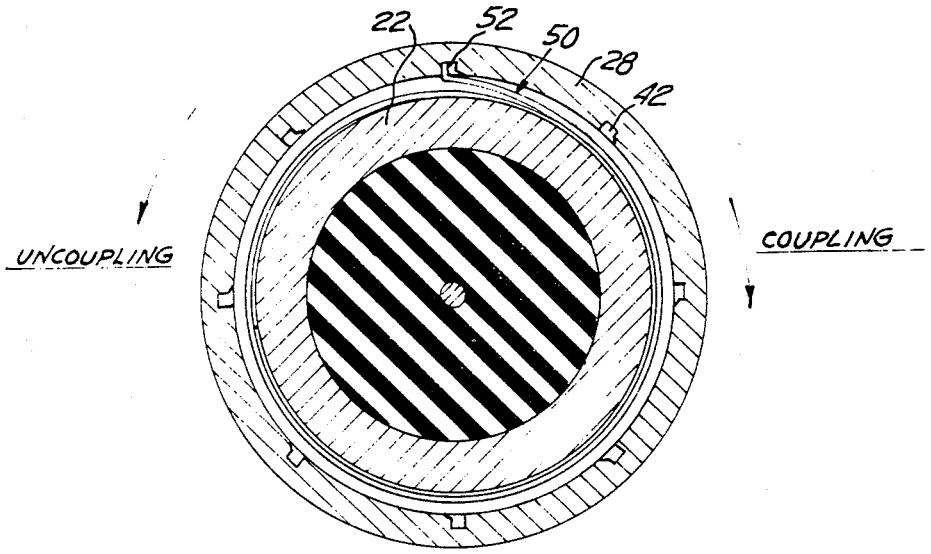
FIG. 3

ANTI-DECOUPLING MECHANISM FOR AN ELECTRICAL CONNECTOR ASSEMBLY

This invention relates to an anti-decoupling mechanism for an electrical connector assembly.

Electrical connector assemblies are generally comprised of two separable connector members and a coupling member having a radial flange rotatably mounted to adajacent to an annular flange on one of the connector members for connecting to the other connector member, each of the respective connector members supporting a plurality of electrical contacts and each being adapted to mate when the coupling member is threadably engaged with thread on the other connector member and rotated, the connector assembly being held together by friction forces developed between engaged threads and abutted flanges. During assembly, the connector members must be easily coupled and decoupled with the application of reasonable external torque by the user but once mated and in use the assembly must remain connected despite vibrational and/or other forces which might be applied to the connector assembly and which might tend to uncouple the assembly.

Various anti-decoupling devices for resisting unwanted rotation are known. In U.S. Pat. No. 4,109,990 issuing Aug. 29, 1978 to Waldron et al for an "Electrical Connector Assembly Having Anti-Decoupling Mechanism", a straight spring beam is chordally interposed between an inner annular groove in the coupling member and a succession of radial ratchet teeth angularly arranged around the annular flange, the spring beam having a medial tooth arranged such that when the coupling member is rotated in either direction the medial tooth engages the rachet teeth to resist rotation. Such an assembly desirably provides an anti-rotation device which is self-contained and protected during use.

However, while such a spring beam is suitable in many applications, in some vibration environments the straight spring beam could bow upwardly and the medial tooth removed from positive engagement with the rachet teeth resulting in the coupling member rotating one or more ratchet clicks and the flanges axially backing-off from their tightly abutted relation, such axial back-off allowing the connector members to axially hammer against one another. Further, constant engagement between the rachet teeth causes wear on the contacted teeth portions and increases the likelihood of degradation of rotation resistance.

A desirable anti-rotation device for a separable electrical connector would be protectively enclosed, be self-contained, readily permit connection and/or disconnection and would resist uncoupling torques to resist unwanted uncoupling of the assembly once formed.

Accordingly, the present invention is directed to an improved anti-decoupling mechanism for an electrical connector assembly and which overcomes the difficulties and disadvantages associated with prior electrical connectors. The electrical connector assembly comprises a pair of generally cylindrical connector shells adapted for mating engagement along their primary axis and an internally threaded coupling nut rotatably mounted to one of the connector members for threadably coupling to the other connector, the one connector member including an annular flange and the coupling nut comprising a generally cylindrical coupling sleeve having a radial flange rotatably mounted to the one connector member and internal thread to threadably connect to the other connector member upon coupling rotation in one direction, the radial flange having a forwardly facing end wall abutting a rearwardly facing end wall of the annular flange for rotation thereabout, coupling rotation of the coupling nut drawing the thread and the flanges tightly together.

The anti-decoupling mechanism is adapted to resist only uncoupling rotation of the coupling nut and is characterized by a thin, elongated, substantially flat band of flexible material coiled radially more than once around itself and about the one connector member such that one end portion of the band is confined adjacent the one connector member and the other end portion includes a tab which is received within one of an equiangularly disposed succession of longitudinal detents extending radially outwardly and formed in the inner wall of the coupling sleeve circumjacent the radial flange of the coupling nut, the band being partially uncoiled relative to the one connector when in a first position and constrained to slide thereabout by the coupling nut rotating in a coupling direction, the band being tightly coiled around the one connector member when in a second position as a result of the detent in the coupling nut driving against the tab whereby friction force developed between the tightly coiled surfaces of the band and the tightly abutted flanges restrain the coupling nut from rotating relative to the other connector member.

In one embodiment, the flat surfaces of the band are slightly roughened to augment resistance to unwanted relative sliding and the coupling nut is comprised of a material having low mass.

An advantage of this invention is a self-contained anti-rotation resisting device which is readily adaptable to the standard plug connector shells.

One way of carrying out the invention as described below with reference to the drawings which illustrate one specific embodiment of this invention, in which:

FIG. 2 is a side view, in section, of a connector member of FIG. 1 provided with the anti-decoupling device.

FIG. 3 is a view taken along lines III—III of FIG. 2.

FIG. 4 is an enlarged view of a portion of the detent and locking tab during uncoupling.

Figure 1:
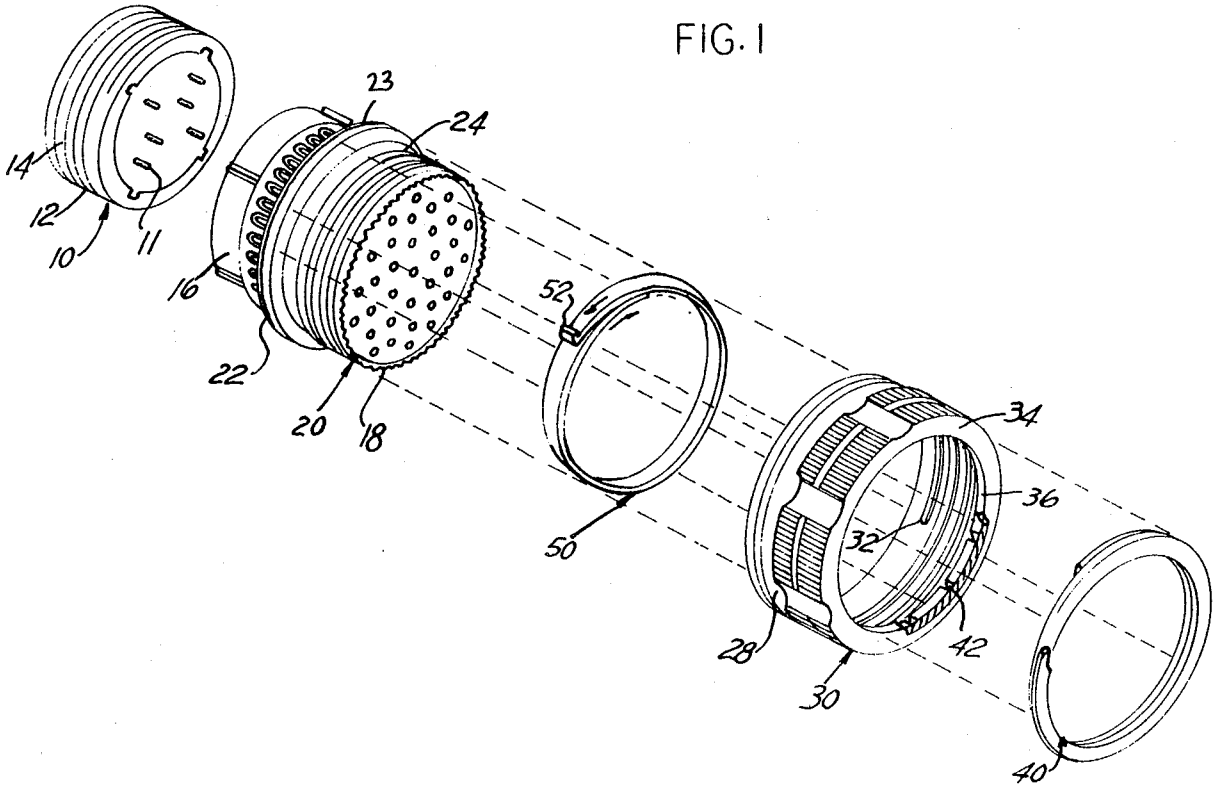
FIG. 1 is an exploded view of an electrical connector assembly having an anti-decoupling device according to the present invention.

Referring now to the drawings, FIG. 1 shows an exploded view of an electrical connector assembly aligned along its primary axis for mating and comprising a receptacle connector 10 including a generally cylindrical shell having a forward portion 12 thereof provided with external thread 14 on its outside periphery and carrying a plurality of electrical pin-type contacts 11 therein, a plug connector 20 including a generally cylindrical shell having forward and rearward portions 16, 18, an annular flange 22 medially of the shell portions and a stepped groove 24 circumjacent the annular flange. A coupling nut 30 is adapted to be rotatably mounted to plug shell 20 for connecting the assembly together, the coupling nut comprising a generally cylindrical coupling sleeve 28 having thread 32 on its internal wall and a flange 34 extending radially inward of the sleeve and adapted to abut against annular flange 22 for rotation thereabout, radial flange 34 having a circumferential face 36 defining an opening sized to fit rearward portion 18 to clarence fit stepped groove 24, external thread 14 being adapted to engage with the internal thread 32 and the receptacle shell 10 sized to interfit about the plug shell 20 and within the coupling sleeve 28 whereby when the coupling nut 30 is rotated the thread surfaces and flange faces are drawn tightly together. An expansible ring 40 having an opening slightly less than the outside diameter of rearward portion 18 is received within stepped groove 24 to retain the coupling nut on the plug shell.

Preferably and in accord with this invention a plurality of longitudinal detents 42 are disposed generally equiangularly around the inner wall of coupling nut 30 and an elongated band 50 is adapted to be radially wrapped around itself several times and around plug connector 10 and connected to coupling nut 30, the band being comprised of flexible material for coiling and uncoiling about the plug connector as a result of the coupling nut rotating from a first position to a second position, the elongated band 50 being partially uncoiled and free to slide relative to the plug shell when in the first position whereby the coupling nut is not restrained from rotating relative to either of the connector shells 10, 20 and tightly coiled relative to the plug shell 20 when in the second position whereby friction forces developed between the plug shell and the surfaces of the tightly coiled band restrain the band from rotating relative to plug shell 20 and the connection to the coupling nut 30 restrains the coupling nut from rotating relative to the plug shell. One end of band 50 includes a tab 52 extending substantially perpendicularly therefrom and to the axis of the band and sized to be received within each of the detents 42.

The band is substantially flat and of generally rectangular cross-section with the long and short dimensions of the band, when coiled, being longitudinally and radially disposed relative to the primary axis of the connector assembly.

FIG. 2 shows coupling nut 30 mounted to plug shell 20 by retaining ring 40, elongated band 50 radially wrapped about itself and around the outer periphery of plug shell 20, the plug shell carrying a socket contact 21 therein for mating with one of the pin contacts 11. Band 50 is wrapped around the outer periphery of annular flange 22 with tab 52 at one band end portion being received within one detent 42 and the other band end portion being closely confined by the overlapping band adjacent to the annular flange for slidable rotation therearound.

FIG. 3 shows the tab 52 received within one detent 42 and the elongated band 50 being radially wrapped in overlapping fashion about itself a couple of times and around the outer periphery of annular flange 22 of plug shell 20. Each of the arrows "A" and "B" show uncoupling and coupling directions, respectively, of coupling nut 30 relative to plug shell 20.

FIG. 4 shows one detent 42 and uncoupling rotation of coupling sleeve 28 relative to plug shell 20. The detent includes first and second spaced end walls 44, 46 which are generally radially extending from inner wall of the coupling sleeve 28 with a cam 48 being formed on second end wall 46, the first end wall 44 being adapted to drive against tab 52 in the coupling direction and second end wall 46 with cam 48 being adapted to drive against tab 52 in the uncoupling direction.

During coupling rotation of the coupling sleeve the first end wall 44 of detent 42 tends to assure partial uncoiling of the band 50 and causes the band to slide about the outer periphery of annular flange, the band thereby offering virtually no resistance to rotation of the coupling nut. During uncoupling rotation of the coupling sleeve 28, the tab 52 is drive out from the detent after sufficient external torque is applied to the coupling sleeve. During initial uncoupling rotation, second end wall 46 bears against tab 52 which tends to deflect tab 52 relative to the band 50 and from its perpendicular relation causing an edge 45, formed by the intersection of end wall 46 and cam 48, to bear against the tab and further drive the end portion of the band radially inward. This inward motion tends to wrap the band tightly about itself. Upon increased external torque tab 52 is cammed radially inward toward the coil and from its detent whereupon the coupling nut is permitted to rotate and advance the next successive detent whereupon the tab is snapped therewithin giving an audible ratcheting click.

To increase the tight resistance to sliding in an uncoupling direction the opposite faces or portions thereof of band 50 may be slightly roughened. Further, to minimize effects of vibration which would act on coupling sleeve 28, the coupling nut would be comprised of a material having low mass so as not to impart dynamic forces to the tab 52.

We claim:

1. An anti-decoupling mechanism for a separable electrical connector assembly, the electrical connector assembly comprising first and second generally cylindrical connector shells adapted for mating engagement along their primary axis and a coupling nut including a coupling sleeve mounted for rotation relative to one of said connector shells and having thread adapted to engage with corresponding thread on the other connector shell, said coupling nut and one connector shell including, respectively, an annular flange and a radial flange with said mounting disposing the flanges in abutting relation whereby coupling rotation of the coupling nut axially draws the flanges tightly against one another and the thread into tight frictional engagement, said anti-decoupling mechanism resisting only uncoupling rotation of the coupling nut, the anti-decoupling mechanism characterized by:

a thin, flat, elongated band of flexible material having one end portion thereof connected to said coupling sleeve and its other end portion thereof radially coiled about said one connector member, the intermediate portion of said band radially overlapping and superposing itself such that the other end portion is closely confined by the band against the one connector shell, rotation of the coupling nut from a first position to a second position driving the band from a loosely coiled and a tightly coiled condition, respectively, relative to said one connector member, said loosely coiled condition not resisting rotation of the coupling nut relative to either of the connector members and said tightly coiled condition resisting rotation of the coupling nut and said one connector member as a result of friction forces developing between overlapped band portions.

2. The invention as recited in claim 1 wherein said coupling sleeve includes an interior annular recess circumjacent to said annular flange, said annular recess circumposing the periphery of said radial flange, said interior annular recess includes a plurality of radial detents extending longitudinally and said elongated band is disposed around the periphery of said radial flange.

3. The invention as recited in claim 2 wherein said one end portion of the band includes a tab extending substantially perpendicularly from the band relative to the band surface and releasably received within one detent, uncoupling rotation of the coupling nut driving against the tab to thereby flex the tab relative to the band and cam the tab radially inward therefrom and outward of its detent, whereby the coupling nut is advanced and the tab snapped into the next successive detent.

4. The invention as recited in claim 2 wherein each detent includes first and second end walls with the first end wall being generally radially extending and the second end wall having a cam portion, the second end wall being adapted to abut the tab to deflect the tab relative to the band and the cam being adapted to drive the tab radially inward from the detent.

5. The invention as recited in claim 4 wherein an annular lip extends radially from said radial flange, said annular lip and annular flange defining an radial groove therebetween and seating the band around the radial flange.

6. The invention as recited in claim 1 wherein the band overlaps several times.

7. The invention as recited in claim 1 wherein said band has inner and outer surfaces with each said surface having slightly roughened portions to enhance resistance to uncoiling and relative sliding motion.

8. The invention as recited in claim 1 wherein said coupling sleeve is comprised of a material having low mass.

* * * * *